US005680673A

United States Patent [19]

Beshore

[11] Patent Number: 5,680,673

[45] Date of Patent: Oct. 28, 1997

[54] PROTECTIVE GLIDE DEVICE

[76] Inventor: Burrus D. Beshore, 3116 S. Lincoln St., Englewood, Colo. 80110

[21] Appl. No.: 442,171

[22] Filed: May 16, 1995

[51] Int. Cl.[6] ..... A47B 91/06

[52] U.S. Cl. ..... 16/42 R; 16/42 T; 248/188.3

[58] Field of Search ..... 16/42 R, 42 T; 248/188.3, 188.5, 631, 632, 156, 615

[56] References Cited

U.S. PATENT DOCUMENTS

| | | | |
|---|---|---|---|
| 1,159,570 | 11/1915 | Clark | 16/42 R |
| 1,356,797 | 9/1920 | Stock | 16/42 |
| 1,638,725 | 8/1927 | Chesnutt | 16/42 R |
| 1,969,266 | 8/1934 | Herold | 16/42 R |
| 2,820,240 | 1/1958 | Matys | 16/42 R |
| 2,992,509 | 7/1961 | Gaenzle | 16/42 R |
| 3,080,601 | 3/1963 | Kramcsak, Jr. | 16/42 T |
| 3,326,508 | 6/1967 | Born | 16/42 R |
| 3,505,724 | 4/1970 | Leitner et al. | 16/42 R |
| 3,516,112 | 6/1970 | Neville et al. | 16/42 R |
| 3,646,633 | 3/1972 | Meinhardt | 16/42 R |
| 4,919,386 | 4/1990 | Cassina . | |
| 5,042,764 | 8/1991 | Carpinella et al. . | |
| 5,042,765 | 8/1991 | Widerstrom . | |
| 5,081,740 | 1/1992 | Smith | 16/42 R |
| 5,220,705 | 6/1993 | Bushey . | |

*Primary Examiner*—Chuck Y. Mah

*Attorney, Agent, or Firm*—Timothy J. Martin; Michael R. Henson

[57] ABSTRACT

A protective glide is adapted to be interfaced between a support surface and a foot portion of a legged object to protect the support surface against abrasion. The glide comprises a unitary body constructed of a non-abrasive material of sufficient stiffness to withstand compressive forces of the legged object against the surface thereby to resist collapse. The unitary body is mountable to the foot portion and as a lower area operative to contact the support the surface and an upper area opposite the lower area which is in facing relationship to the foot portion when mounted. The unitary body has a plurality of cavities formed therein with web elements separating adjacent one of these cavities. Preferably, a resilient member is interposed between the foot portion and the glide device and operates to conform the contours on a contact surface of the foot portion to stabilize the support log on the support surface.

20 Claims, 3 Drawing Sheets

PROTECTIVE GLIDE DEVICE

FIELD OF THE INVENTION

The present invention relates to a protective glide device for use with various types of structures which are supported above a support surface by a plurality of legs. More particularly, the present invention relates to a protective glide device which is adapted to be secured to the foot portion of patio furniture in order to protect both the chair's legs and the support surface from damage.

BACKGROUND OF THE INVENTION

Few would disagree that furniture plays a vital role in man's everyday life. Among the various uses of furniture, whether in the household or the work environment, include the need to store items, display items or provide other types of working surfaces. Certain types of furniture, such as chairs, desks, bar stools and the like, include a plurality of legs which normally engage a surface in order to support the furniture thereon. The necessity of having these types of support structures has become commonplace, and manufacturers have been able to appeal to consumer's desires by constructing them to have a variety of unique designs and shapes.

Most furniture is inherently designed to be a durable commodity so that its owners may enjoy a significant lifetime of use from it. As is often the case, whether due to manufacturing defects, climactic changes or wear and tear from use, supported structures can become improperly balanced on their support surfaces. The unfortunate result of this can be inadvertent damage to either the objects placed on the furniture or the furniture itself. For seated structures, inadequate means of leveling can also result in discomfort or injury to a user.

Of equal concern is the need to avoid damage or abrasion to support surfaces on which legged structures rest. For furniture used indoors, this support surface is typically either carpeting or wooden floors. For outdoor furniture, such as patio furniture, the support surface may be concrete, brick, tile, decking and the like. Regardless of the support surface encountered, one runs the risk that manufacturing imperfections may either scratch or tear the surface; similar damage may occur when the furniture shifts or slides across the surface. In an effort to alleviate these problems, several types of protective devices have been developed. For furniture which is not ordinarily moved, it is not uncommon for one to place a shim(s) or its equivalent under one or more of the support legs in order to balance the furniture on the support surface. Glide devices have also been used as a means for leveling or adjusting furniture. For example, iron patio furniture often comes factory supplied with an available cup-shaped glide device. Typically, the glide housing at the distal end of a support leg comprises an inverted metal cup that is welded to the end of the furniture's legs. The glides themselves are affixed by radial compression and friction to the interior walls of the inverted metal cups. However, as a result of manufacturing defects in the furniture or uneven support surfaces, these glides are not always effective at adequately addressing the aforementioned concerns.

One particular glide device which has been widely used is a cup-like structure formed of a plastic material which has an open mouth region received in the confines of the inverted metal cup. The base end of the glide device rests on the support surface when in the mounted state. With this type of construction, the glide device tends to conform to whatever position the steel cup was welded in. A problem with this type of glide is the inability, over time, of its sidewalls to withstand compressive forces exerted thereon. When used on uneven support surface, the plastic cup glide tends to distort further. Over time, the inverted cup either grinds through whatever portion it is contact with or causes the sidewalls to crush downwardly and tear away.

Another problem associated with this type of glide is that its exterior surface has a tendency to scratch the support surface even though it may be temporarily protecting the furniture's legs.

Others have also tried to address these problems. For example, U.S. Pat. No. 4,919,386 issued Apr. 24, 1990 to Cassina teaches a foot portion for a table leg which is formed by a stack of similarly upwardly tapered disks which pivot about an axis which holds them together and provides means of attachment. This device is particularly effective for fixed wooden tables but would not provide the continual floating action needed for other types of furniture. U.S. Pat. No. 5,042,764 issued Aug. 27, 1991 to Carpinella et al teaches a glide device having a spring loaded or urethane cushion which is riveted within a housing assembly to adjust for uneven loads or surfaces. In U.S. Pat. No. 5,220,705 issued Jun. 22, 1993 to Bushey, a concavo-convex disk is used with an adhesive, resilient means of attachment in the center.

While all of these prior art devices are advantageous in their own right, there remains a need for an improved glide device which can be interposed between a foot portion of a legged object and a support surface to provide stability to the legged structure while preventing unnecessary damage to either the support surface or the structure. There is a further need for such an improved glide device which is especially constructed for use with iron patio furniture.

SUMMARY OF THE INVENTION

An object of the present invention is to provide a new and useful protective glide which is mountable to a foot portion of a legged object which can be supplied as an original equipment item or as a retrofit element.

Another object of the present invention is to provide a self-adjusting protective glide which is adapted to be mountable onto a foot portion having various shapes and sizes.

A further object of the present invention is to provide a protective glide having non-marring characteristics, while being able to withstand compressive forces exerted by a legged object against a support surface.

A still further object of the present invention is to provide a self-adjusting protective glide which is able to compensate for various surface contours of a legged object to which it is attached in order to properly stabilize the legged object on the support surface.

Yet another object of the present invention is to provide a resilient member adapted for use with a variety of types of glide devices.

The protective glide of the present invention is employed to removably interface between a support surface and a foot portion of a legged object placed thereon so as to protect the support surface against abrasion from the foot portion. Broadly, this protective glide is a unitary body constructed of a non-abrasive material of sufficient stiffness to withstand compressive forces of the legged object against the support surface. With such a construction, the glide is able to resist collapse and avoid any unnecessary damage to either the legged object or the support surface. The unitary body is mountable to the foot portion and has a lower area operative to contact the support surface and an upper area which is in facing relationship to the foot portion when mounted. A plurality of cavities are formed within the unitary body and separated from one another by web elements. It is preferred that the protective glide be formed as a cylindrical body having a central axis extending between the upper and lower surfaces and having an outer sidewall.

In one embodiment of the present invention, these cavities were spaced equiangularly around the central axis and extend from respective cavity openings at the upper area axially toward the lower area. Here it is preferred that the cavities are pie-shaped in configuration and that the body is cylindrically shaped having its lower area formed as a continuous, uninterrupted surface adapted to contact the support surface. In another embodiment, the body has a surrounding sidewall and the cavities are formed as radial bores within the surrounding sidewall, which bores extend from the sidewall to terminate proximate to a center of the body. Here, the unitary body also has a central bore which extends from the upper area to terminate at a medial region within the body, and at least some of the radial bores intersect the central bore.

A resilient member may also be disposed between the foot portion and the glide device. This resilient member operates to stabilize the support leg on the support surface by conforming to contours on a surface of the foot portion. It is also operates in response to compressive forces exerted thereon by its respective foot portion to partly ingress into at least some of the cavities. The resilient member may be toroidal in shape and constructed of a high density foam material, such as polyurethane, and includes an adhesive layer on each of its upper surface and lower surface for securing the resilient member to the foot portion and the glide device, respectively. Alternatively, a silicone based compound provides the resilient member.

The present invention also contemplates an article of furniture which is adapted to be stabilized on a support surface in order to protect the support surface against abrasion. The article of furniture comprises a working surface and a plurality of support legs which are disposed between the working surface and the support surface. Each of these support legs has a foot portion which is adapted to rest on the support surface. A protective glide is associated with each foot portion and adapted to interface between its respective foot portion and the support surface. Each of these glides is also formed as a unitary body constructed of a non-abrasive material of sufficient thickness to resist compressive forces in the configurations described above. A resilient member, also in the configuration described above, is interposed between the upper area of each protective glide and its respective foot portion, which resilient member is operative to conform to surface contours of its respective foot portion to stabilize and balance the article of furniture on the support surface. Each of the foot portions may be formed as an inverted cup which is sized and adapted to conceal its associated resilient member, a majority of its associated protective glide and, where present, any weldment located on the interior surface of the foot portion.

These and other objects of the present invention will become more readily appreciated and understood from a consideration of the following detailed description of the exemplary embodiments when taken together with the accompanying drawings, in which:

DETAILED DESCRIPTION OF THE EXEMPLARY EMBODIMENTS

The present invention is directed to a protective glide which is adapted to provide stability to a legged object, while at the same time preventing damage to either the legged object or a support surface upon which it rests. While the present invention is particularly described with reference to an iron patio chair, the present invention also is adapted for use with other types of structures, such as tables, desks, bar stools or the like, each having some form of "working surface" such as a chair seat, desk top, table top, etc. Various embodiments of the protective glide are described herein, but broadly each embodiment is formed as a unitary body adapted to interface between the support surface and a foot portion of the legged object placed thereon in order to protect the support surface against abrasion by the foot portion.

Figure 1:
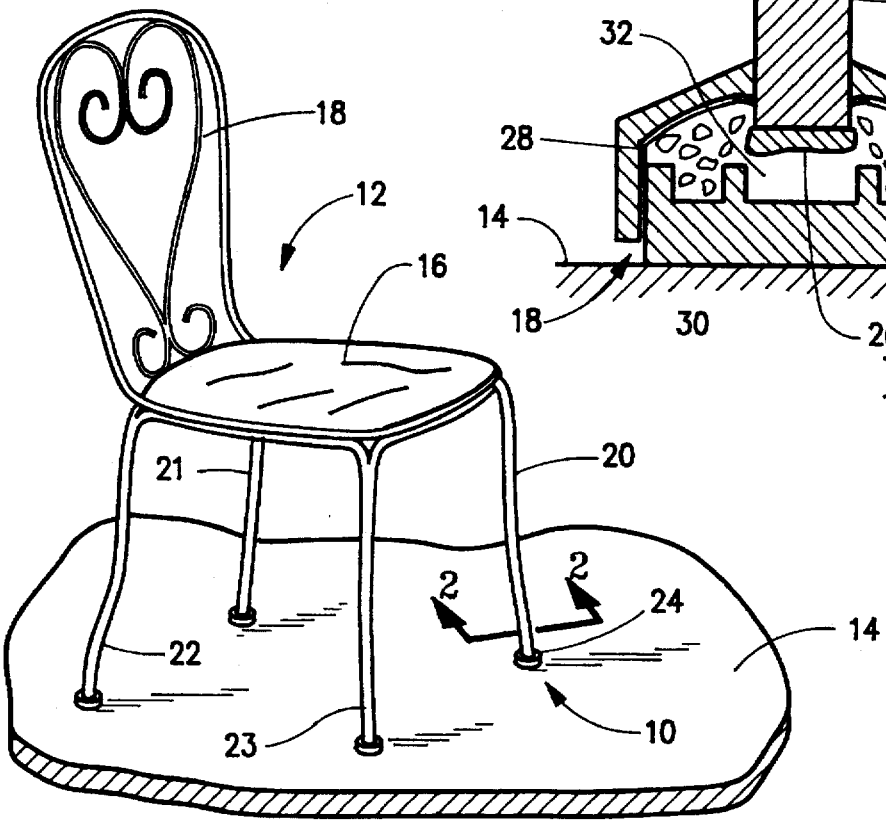
FIG. 1 is a perspective view of a first exemplary embodiment of the protective glide of the present invention shown mounted on a foot portion of a legged object, here depicted as an iron patio chair.

A first embodiment of the present invention is shown in FIGS. 1–6. In FIG. 1, the protective glide 10 is mounted on a legged object 12 which, in this instance, is an iron patio chair. The iron patio chair rests on a support surface 14 and includes a working surface 16 in the form of a cushioned seat, a chair backing 18 and a plurality of leg members 20–23. The protective glide 10 is adapted to be mounted to a foot portion of each of legs 20–23 so that it is interposed between a foot portion and the support surface 14. The construction of a representative protective glide 10 and its mountability to one of he legs 20–23 is best shown with reference to FIGS. 2 and 3. Of course, it should be understood that an identical protective glide 10 would be associated with each of legs 20–23 of chair 12.

Figure 2:
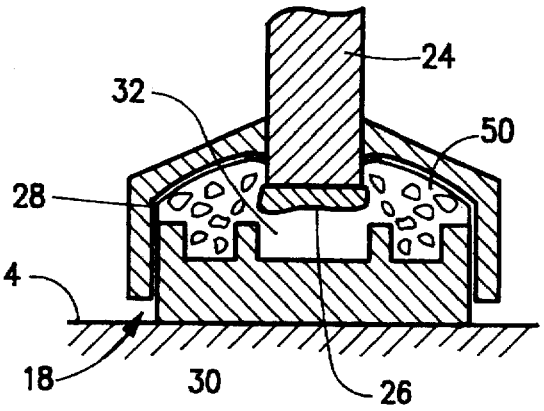
FIG. 2 is an enlarged cross-sectional view taken about lines 2—2 of FIG. 1.
Figure 3:
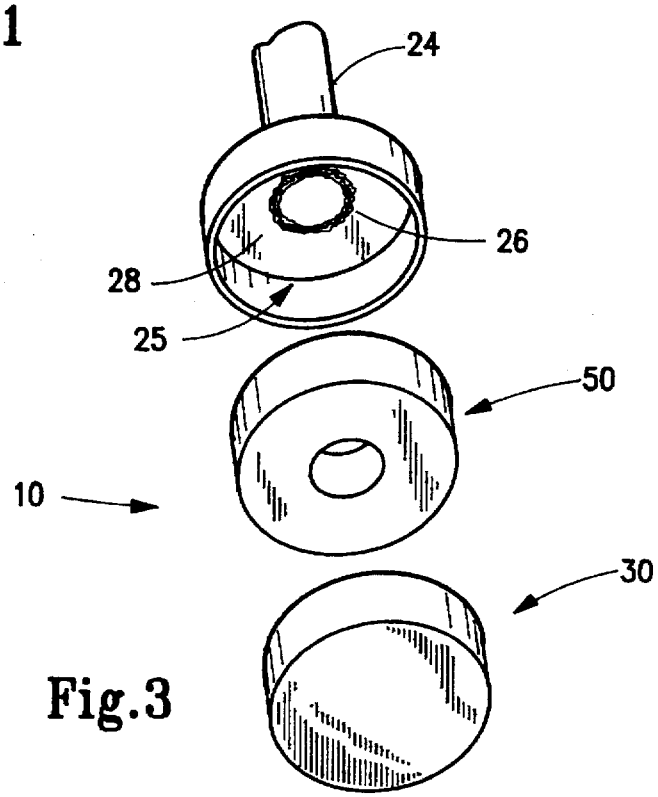
FIG. 3 is an exploded perspective view of the glide, resilient member and foot portion of FIG. 2.
Figure 6:
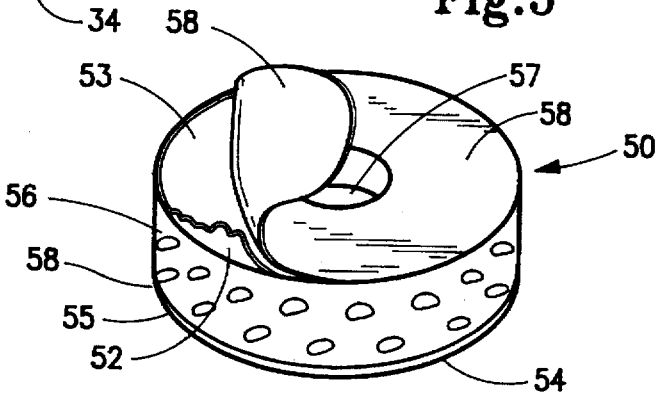
FIG. 6 is a perspective view of the resilient member according to the first exemplary embodiment of the present invention and showing an upper layer of foam tape peeled back to expose an adhesive coating.

In FIG. 2, then, protective glide 10 is shown mounted to foot portion 24. Foot portion 24 is formed as an inverted metal cup having a downwardly protruding weldment 26 formed along an interior surface 28 thereof. The protective glide 10 is interposed between support surface 14 and foot portion 24, as is also shown in FIG. 3. As is also shown in these figures, a resilient member 50 is interposed between the protective glide 10 and foot portion 24. Resilient member 50, which will be described in more detail below with reference to FIG. 6, provides additional cushioning support so that foot portion 24 may be stabilized on support surface 14. Protective glide 10 is constructed as a unitary body 30 made from a non-abrasive material, such as polyethylene, nylon, polyoxymethylene homopolymer or other acetyl resin or the like, and is dimensioned of sufficient thickness to withstand normal compressive forces exerted thereon when chair 12 is in use.

When in the mounted state, then, it may be seen that both the resilient member 50 and the protective glide 10 are received within mouth 25 of foot portion 24 so that the inverted metal cup conceals its associated resilient member 50 and a majority of the protective glide 10. Weldment 26 is partially received in a central cavity 32 which is formed within protective glide 10.

Figure 4:
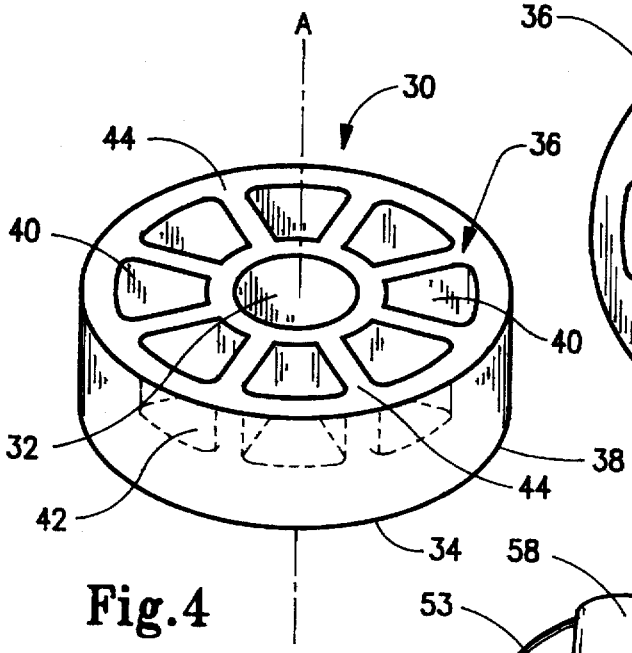
FIG. 4 is a perspective view of the protective glide according to the first exemplary embodiment of the present invention shown in FIGS. 2 and 3.
Figure 5:
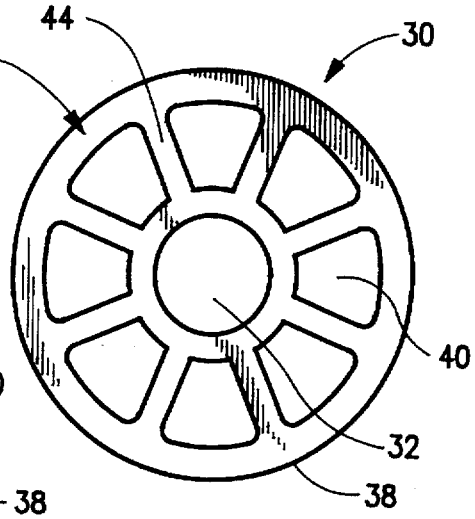
FIG. 5 is a top view of the protective glide shown in FIGS. 2–4.

The preferred construction of unitary body 30 is shown with reference to FIGS. 4 and 5. Unitary body 30 is formed as a cylinder having a continuous, uninterrupted lower area 34, an upper area 36, and is defined by a continuous, uninterrupted outer surrounding sidewall 38 extending between upper and lower surface areas 34 and 36. The unitary body 30 is centered about an imaginary axis central "A" which passes through central cavity 32. A plurality of cavities or cells 40 are also formed within unitary body 30, preferably by an injection molding process, and extend in axial directions from upper area 36 to terminate at a medial region 42 within unitary body 30 (see FIG. 2 and phantom lines of FIG. 4). Cavities 40 are spaced equiangularly around axis "A" and central bore 32, and are separated from one another by web elements 44 so that unitary body 30 is formed to have a honeycombed-like structure. The web elements 44 are formed as interior walls, typically two millimeters to three millimeters thick, and provide beam structure against vertical collapse by distributing pressure throughout unitary body 30. At the same time, web elements 44 also provide some slight resiliency so that protective glide 10 may respond to different compressive forces exerted thereon by foot portion 24. Additionally, the pie-shaped cavities 40 form regions of ingress for resilient member 50 as it responds to compressive forces.

The resilient member 50 according to the preferred embodiment of the present invention is shown with reference to FIG. 6, wherein it may be seen that resilient member 50 is in the shape of a toroid and formed of a high-density foam material, such as polyurethane. Polyurethane has been found to have advantages over other types of material because of its ability to compensate for, and conform to, uneven factory assembly of the foot portion 24 and the varying loads which may be placed thereon. Resilient member 50 has an upper surface 52 and a lower surface 54 which are separated from one another by a surrounding sidewall 56 of a given thickness. Both the upper surface 52 and the lower surface 54 include adhesive layers, such as adhesive layers 53 and 55 respectively, for securing the resilient member 50 between unitary body 30 and the interior surface 28 of said portion 24. These layers are protected by a relief paper, such as relief paper 58, prior to use. Here, resilient member 50 is affixed with a thick, high-density foam, double sided adhesive tape layers 53 and 55. When mounted, then, tape layer 55 secures to upper area 36 of unitary body 30. Upper surface 52 is securedly engaged within interior surface 28 of foot portion 24 by tape layer 53. As with unitary body 30, resilient member 50 also has a central cutout 57 which is sized and adapted to receive the weldment 26 therethrough. It should be understood that resilient member 50 is a self-adjusting member because it automatically conforms to contours on the interior surface 28 of foot portion 24 to balance foot portion 24, and thus leg 20, on support surface 14.

Figure 7:
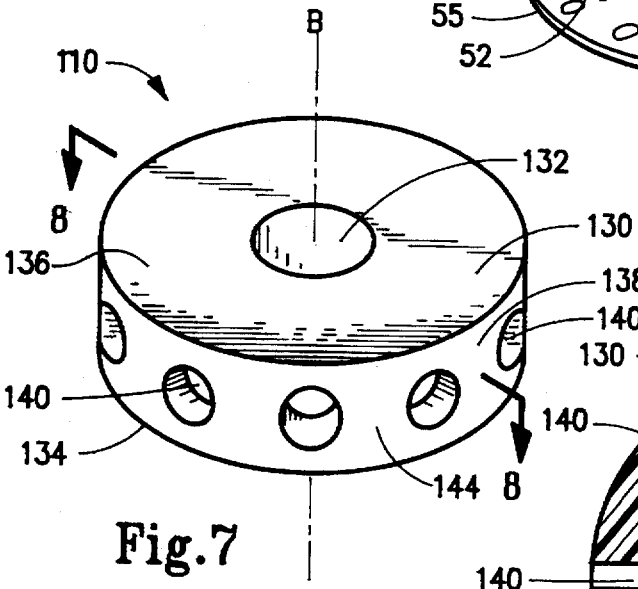
FIG. 7 is a perspective view of an alternative embodiment of the glide device according to the present invention.
Figure 8:
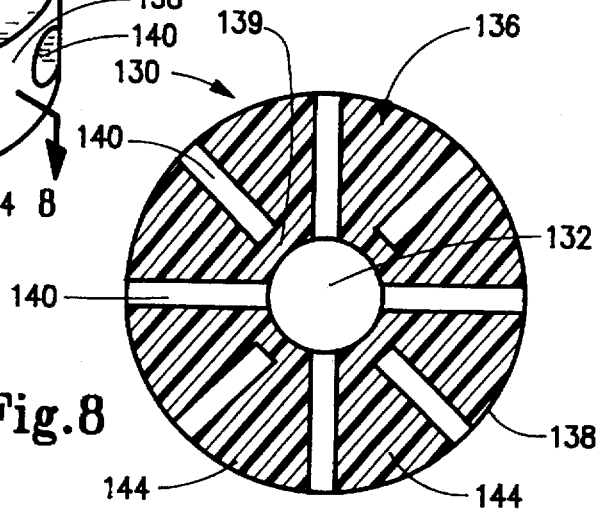
FIG. 8 is a top view, along lines 8—8 of FIG. 7, of the glide device according to an alternative embodiment of the present invention.
Figure 9:
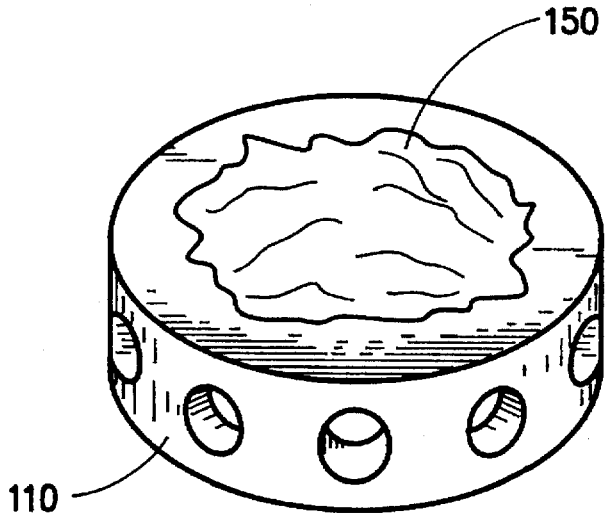
FIG. 9 is a perspective view of the glide device of FIGS. 7 and 8 showing an alterative embodiment of a resilient member which may be used in conjunction therewith.

A second exemplary embodiment of the protective glide is shown with reference to FIGS. 7–9. Here again protective glide 110 is formed as a cylindrical, unitary body 130 which is centered about an imaginary axis "B" passing therethrough. Unitary body 130 is defined by an upper area 136 and a continuous, uninterrupted lower area 134 which is separated therefrom by an outer surrounding sidewall 138. Formed within upper area 136 and extending in a downward direction to a medial region of unitary body 130 is a central bore 132 which is sized and adapted to receive part of weldment 26 of foot portion 24. In this embodiment, protective glide 110 also has a plurality of interior cavities or cells 140 formed therein which are separated from one another by web elements 144. These cavities 140 are spaced equiangularly around central axis "B". In this embodiment, however, cavities 140 are cylindrically shaped and extend outwardly in radial directions from axis "B". Alternating ones of these cylindrical cavities are shown to extend from outer surrounding sidewall 138 to intersect central bore 132, while others extend from outer surrounding sidewall 138 to terminate at a region 139 which is proximate central cavity 132. As in the first exemplary embodiment discussed above with reference to protective glide 110, unitary body 130 resembles a honeycombed structure comprising the cells 140 and the web elements 144 and may be formed by injection molding from a polyethylene material.

While the resilient member 50 may also be used in this second exemplary embodiment of the present invention it has been found that a different type of resilient member 150 as shown in FIG. 9 may also be employed.

Here, resilient member 150 is a compound selected from the silicone caulk family of adhesive sealants or comparable compounds. This form of resilient member 150 seems better adapted for protective glide 110 because it is able to more easily seep and ingress into the cylindrical cavities 140 when in the mounted state. This permits the silicone compound to both respond to various types of compressive forces exerted thereon and to better secure itself to protective glide 110 when mounted.

Figure 10:
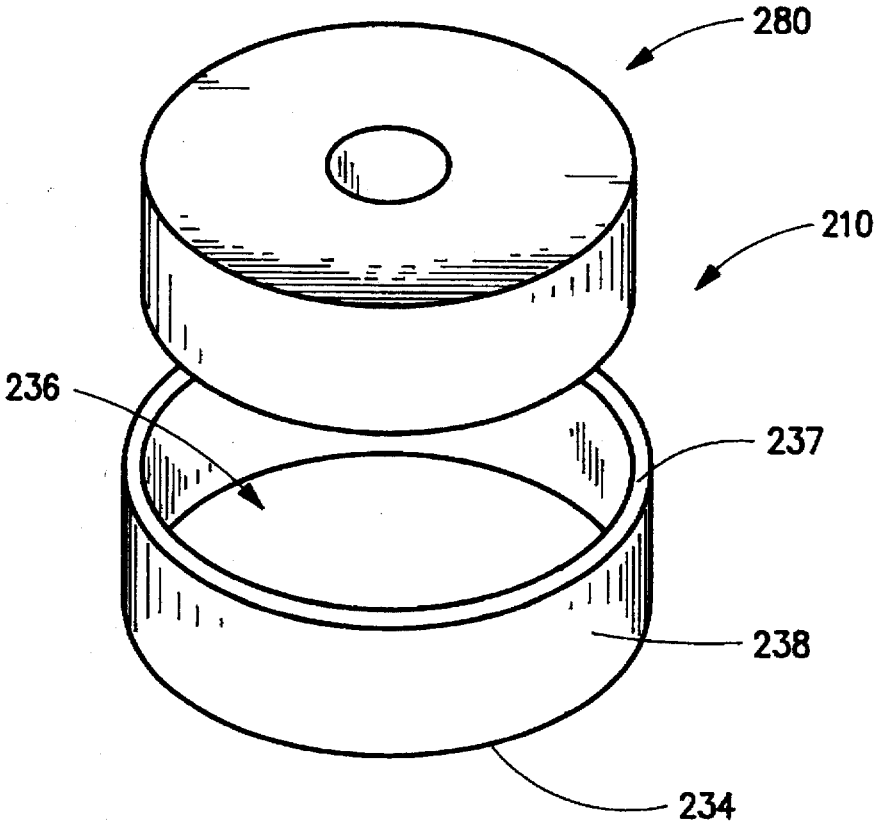
FIG. 10 is an exploded perspective view of a third embodiment of the present invention.

FIG. 10 shows a third alternative embodiment of the present invention. Here, the toroidally shaped resilient member described above with reference to FIG. 6 is used with a protective glide 210 that is constructed as a cup-like member having an upright surrounding sidewall 238 which extends from a base surface 234 of glide 210 to terminate at a mouth 236 which is defined by rim 237. Resilient member 250 is received in mouth 236 and is of identical construction as the resilient member 50 described with respect to the first exemplary embodiment of the present invention. This employment of resilient member 250 is actually an improvement to existing glide devices which have heretofore been used. Often, iron patio chairs come factory supplied with glides constructed similarly to protective glide 210. However, they do not include any kind of resilient member disposed therein and, therefore, their sidewalls are prone to collapse and become damaged with time. This results in both damage to the foot portion and the support surface upon which the patio chair rests. Accordingly, Applicant has recognized the added benefit of providing a resilient member 250 which is disposed within glide 210 and provides added reinforcement to resist collapse under compressive forces.

With the foregoing construction in mind, it may be readily understood and appreciated by one of ordinary skill in the art that the above embodiments, when used in conjunction with an article of furniture, such as the iron patio chair 12 of FIG. 1, results in a self-adjusting glide having non-maring characteristics. For example, the protective glides associated with each of the legs 20–23 of patio chair 12 are able to "float" independently as the chair comes into contact with different support surface contours. Individually, each glide follows the contour of the support surface, while maintaining stability with regard to its own respective foot portion. This ability to stabilize is predominantly accomplished by the resilient member which is able to expand or contract in response to different compressive states. The overall result is a self-adjusting glide assembly which substantially reduces or eliminates tilting and wobbling of the patio chair 12. Of course, it should also be understood by one of ordinary skill that the particular construction for the unitary bodies and the resilient members should not be unduly limited to those discussed herein. That is, the glide device's unitary body may take on a variety of different shapes and sizes depending on the construction of the foot portion with which it is used. The same is also true for the construction and properties of the resilient members discussed above.

Accordingly, the present invention has been described with some degree of particularity directed to the exemplary embodiments of the present invention. It should be appreciated, though, that the present invention is defined by the following claims construed in light of the prior art so that modifications or changes may be made to the preferred embodiments of the present invention without departing from the inventive concepts contained herein.

I claim:

1. A protective glide adapted to interface between a support surface and a foot portion of a legged object placed thereon for protecting said support surface against abrasion by said foot portion, comprising:

a unitary body constructed of a non-abrasive material of sufficient stiffness to withstand compressive forces of said legged object against said support surface thereby to resist collapse, said unitary body mountable to said foot portion and having a lower area operative to contact said support surface, an upper area opposite said lower area and in facing relationship to said foot portion when mounted, and a central axis extending between the upper and lower areas, said unitary body having a plurality of cavities formed therein and including web elements separating adjacent ones of said cavities.

2. A protective glide according to claim 1 wherein said cavities are spaced equiangularly around said central axis.

3. A protective glide according to claim 2 wherein said body has a continuous, uninterrupted surrounding sidewall, said cavities each extending from respective cavity openings at the upper area axially toward the lower area, said lower area formed as a continuous, uninterrupted surface adapted to contact the support surface.

4. A protective glide according to claim 3 wherein said body is cylindrically shaped, said cavities being pie-shaped in configuration.

5. A protective glide according to claim 1 wherein said body has a surrounding sidewall, said cavities being formed as radial bores in the surrounding sidewall.

6. A protective glide according to claim 5 wherein said cavities are cylindrical and extend from said sidewall to terminate proximate to a center of said body.

7. A protective glide according to claim 6 wherein said body has a central bore extending from said upper area to terminate at a medial region within said body, at least some of said radial bores intersecting said central bore.

8. A protective glide according to claim 1 including a resilient member secured to said upper area and, said resilient member operative to conform to surface contours of said foot portion to stabilize said legged object on said support surface.

9. A protective glide according to claim 1 wherein said material is selected from a group consisting of: polyethylene, nylon and acetyl resins.

10. In an article of furniture including a support leg having a foot portion adapted to rest upon a support surface and including a glide device interposed between said foot portion and said support surface, an improvement comprising a resilient member formed of a silicon based compound and interposed between said foot portion and said glide device, said resilient member operative to conform to contours on a contact surface of said foot portion to stabilize said support leg on said support surface.

11. The improvement of claim 10 wherein said resilient member is formed from a high density foam material.

12. The improvement of claim 11 wherein said material is polyurethane.

13. The improvement of claim 10 wherein said resilient member is toroidal in shape and has a lower surface operative to engage said glide device and an upper surface operative to engage said foot portion.

14. The improvement of claim 13 wherein said upper surface and said lower surface each include an adhesive layer for respectively securing said resilient member to said foot portion and said glide device.

15. An article of furniture adapted to be stabilized on a support surface and to protect said support surface against abrasion, comprising:

(a) a working surface;

(b) a plurality of support legs disposed between said working surface and said support surface, each of said support legs having a foot portion adapted to rest upon said support surface;

(c) a protective glide associated with each said foot portion and adapted to interface between its respective said foot portion and said support surface, each said protective glide being a unitary body including a plurality of spaced apart cavities formed therein and constructed of non-abrasive material of sufficient stiffness to resist compressive forces exerted thereon by its respective said foot portion thereby to resist collapse, each said glide having a lower area operative to contact said support surface and an upper area opposite said lower area and in facing relationship to said foot portion; and (d) a resilient member interposed between the upper area of each said protective glide and its respective said foot portion, each said resilient member operative to conform to surface contours of its respective said foot portion to stabilize and balance said article of furniture on said support surface.

16. An article of furniture according to claim 15 wherein each said foot portion is formed as an inverted cup which is sized and adapted to conceal its associated resilient member and a majority of its associated protective glide.

17. An article of furniture according to claim 16 wherein each said protective glide is formed to include a central bore extending from said upper area to terminate at a medial region within said glide and each said foot portion includes a weldment formed on an interior surface of said inverted cup and depending in a downward direction therefrom toward said support surface, which weldment is sized and adapted to be partially received in said central bore when said glide is mounted.

18. An article of furniture according to claim 17 wherein said cavities are spaced equiangularly around said central bore and including web elements separating adjacent ones of said cavities, each said resilient member operative in response to compressive forces exerted thereon by its respective said foot portion to partly ingress into at least some of said cells.

19. An article of furniture according to claim 18 wherein each said resilient member is formed from a high density foam material and the cavities of each said protective glide extend from said upper area to terminate at a medial region within said glide.

20. An article of furniture adapted to be stabilized on a support surface and to protect said support surface against abrasion, comprising:

(a) a working surface;

(b) a plurality of support legs disposed between said working surface and said support surface, each of said support legs having a foot portion adapted to rest upon said support surface, each said foot portion formed as an inverted cup and including a weldment formed on an interior surface of said inverted cup and depending in a downward direction therefrom toward said support surface;

(c) a protective glide associated with each said foot portion and adapted to interface between its respective said foot portion and said support surface, each said protective glide being a unitary body constructed of sufficient stiffness to resist compressive forces exerted thereon by its respective said foot portion thereby to resist collapse, each said glide having a lower area operative to contact said support surface and an upper area opposite said lower area and in facing relationship to said foot portion, each said protective glide formed to include a central bore extending from said upper area to terminate at a medial region within said glide so that an associated said weldment is sized and adapted to be partially received in said central bore when said glide is mounted; and (d) a resilient member formed from a silicon based compound interposed between the upper area of each said protective glide and its respective said foot portion, each said resilient member operative to conform to surface contours of its respective said foot portion to stabilize and balance said article of furniture on said support surface.

* * * * *